US009925641B2

(12) United States Patent
Lynn

(10) Patent No.: US 9,925,641 B2
(45) Date of Patent: Mar. 27, 2018

(54) CONTAINMENT SYSTEM OR BARRIER WITH OPEN/CLOSABLE DOORS

(71) Applicant: William R. Lynn, Isle of Palms, SC (US)

(72) Inventor: William R. Lynn, Isle of Palms, SC (US)

( * ) Notice: Subject to any disclaimer, the term of this patent is extended or adjusted under 35 U.S.C. 154(b) by 100 days.

(21) Appl. No.: 15/012,156

(22) Filed: Feb. 1, 2016

(65) Prior Publication Data

US 2016/0221150 A1 Aug. 4, 2016

Related U.S. Application Data

(60) Provisional application No. 62/110,745, filed on Feb. 2, 2015.

(51) Int. Cl.

| | |
|---|---|
| ***B24C 3/10*** | (2006.01) |
| ***B24C 3/06*** | (2006.01) |
| ***B24C 9/00*** | (2006.01) |

(52) U.S. Cl.

CPC ..... *B24C 3/10* (2013.01); *B24C 3/06* (2013.01); *B24C 9/00* (2013.01)

(58) Field of Classification Search

CPC ..... B24C 3/10; B24C 3/06; B24C 9/00

USPC ..... 451/75–102

See application file for complete search history.

(56) References Cited

U.S. PATENT DOCUMENTS

| | | | | | |
|---|---|---|---|---|---|
| 1,774,703 | A * | 9/1930 | Dreisbach | B24C 3/10 | 451/102 |
| 3,031,802 | A * | 5/1962 | Leliaert | B24C 3/14 | 277/355 |
| 5,085,016 | A * | 2/1992 | Rose | B08B 9/023 | 118/305 |
| 5,107,633 | A * | 4/1992 | Rose | B24C 3/32 | 451/76 |
| 5,360,486 | A * | 11/1994 | Elliott | B08B 7/02 | 134/6 |
| 5,398,461 | A * | 3/1995 | Rose | B24C 3/06 | 15/104.04 |
| 5,458,683 | A * | 10/1995 | Taylor | B08B 9/023 | 118/307 |
| 5,836,809 | A * | 11/1998 | Kosic | B08B 11/04 | 451/38 |
| 5,839,945 | A * | 11/1998 | Elliott | 451/80 | |

(Continued)

*Primary Examiner* — George Nguyen

(74) *Attorney, Agent, or Firm* — Davis & Bujold PLLC; Michael J. Bujold

(57) ABSTRACT

A treatment and containment system for treating an elongate object to be treated. The system comprises surface treatment equipment or device for treating a portion of the elongate object to be treated; a housing defines an enclosed treatment area and separates the enclosed treatment area from an operator of the surface treatment equipment or device, and the housing is opened at opposed ends thereof; each opposed opened end of the housing accommodates a pair of movable doors which seal against the elongate object to be treated and thereby closing each opposed opened end of the housing; the housing has an access aperture therein through which the surface treatment device passes and communicates with the enclosed treatment area, and the access aperture facilitates manipulation of the surface treatment device within the housing; and a transparent viewing aperture facilitates viewing of the elongate object to be treated by the operator.

20 Claims, 7 Drawing Sheets

(56) References Cited

U.S. PATENT DOCUMENTS

| | | | | |
|---|---|---|---|---|
| 6,099,395 | A * | 8/2000 | Guseman | B24C 9/00 451/75 |
| 7,140,065 | B2 * | 11/2006 | Boos | B08B 9/023 15/302 |
| 8,556,683 | B2 * | 10/2013 | Lynn | B24C 3/02 451/75 |
| 8,926,407 | B2 * | 1/2015 | Lewkoski | B08B 9/023 15/179 |
| 2012/0315828 | A1 * | 12/2012 | Kuhlman | B24C 3/06 451/38 |
| 2013/0143473 | A1 * | 6/2013 | Hibino | B24C 1/086 451/38 |

* cited by examiner

CONTAINMENT SYSTEM OR BARRIER WITH OPEN/CLOSABLE DOORS

FIELD OF THE INVENTION

The present invention relates to a portable containment system or barrier which is opened at both opposed ends thereof and the open ends of the portable containment system or barrier are closable by a two pairs of cooperating doors in order to form a completely closed and sealed enclosed treatment area within the containment system or barrier.

BACKGROUND OF THE INVENTION

It is known in the art to apply or propel various substances, materials and/or media, e.g., both abrasive and non-abrasive, against a desired surface in order to "treat" the surface, e.g., polish, clean, abrade, prepare a surface for painting, remove rust, grease or oil, etc. The blasting media may consist of dry or liquid material or a combination thereof with or without a variety of abrasive or non-abrasive constituents added thereto. In many applications, the blasting media is a composite media comprising a combination of two or more components which are mixed or blended together with one another, in the desired proportion, to achieve the desired amount surface treatment, e.g., polishing, cleaning, abrading, remove rust, surface preparation, etc. Application of the blasting media by a pressurized applicator generally results in a substantial quantity of media and contaminants becoming airborne and rebounding off of the surface being treated. This rebounding media must be adequately contained within an enclosed treatment area in order to prevent contamination to the surrounding environment with the media and/or removed contaminants and/or debris from the surface being treated. This is especially true if hazardous materials are being removed from the surface being treated.

Containment systems currently known in the art are used in the treatment of objects or surfaces are to be treated including beams, pipes, fixtures, wall, ceilings panels or some other structure. These systems contain the blasting media and other material, contaminant, debris and hazardous material and suppress the harmful affects to a confined area. However, to treat these objects or surfaces, generally an operator would be required to be located inside the containment area and thus exposed and subjected to such hazardous conditions.

Recently, there has been a trend toward designing containment systems and barriers in which the operator is able to stand and be located completely outside the treatment area.

SUMMARY OF THE INVENTION

Wherefore it is an object of the present invention to overcome the noted problems and drawbacks associated with the prior art containment systems, barriers and equipment and permit an operator to be located outside the treatment area.

Another object of the invention is to provide a containment system or barrier, located in close proximity to a surface to be treated, while still allowing the operator to be located completely outside the enclosed treatment area so that the operator is not directly exposed to the blasting media, any contaminant(s) and/or any debris removed from the object to be treated and/or suspended in the air.

Yet another object of the invention is to provide a containment system or barrier that can be readily transported to a remote site and has a pair of opposed, sealable openings which are closable by two cooperating pairs of movable doors. Each pair of openable and closeable sealable openings permit opposed sections of the elongate object to be treated, such as an elongate pipe, I-beam, pole, rod, shaft, etc., to extend out from each opposed end of the containment system or barrier while still facilitating sectional treatment of the object to be treated by the containment system or barrier.

Still another object of the invention is to effectively seal the entire perimeter of the desired section of the object to be treated so as to prevent any media, material, contaminant(s), debris, etc., from escaping the containment system or barrier and thereby facilitate collection of the debris and collection and recycling and/or regeneration of the blasting media. Furthermore, this enables collection and disposal of all of the removed material(s), contaminant(s), debris, hazardous material(s), etc., from the object to be treated.

Another object of the invention is to provide a containment system or barrier that is easily movable along the length of the object to be treated, such as an elongate pipe, I-beam, pole, rod, shaft, etc., thereby ensuring that each desired section of the object to be treated can be sequentially treated by periodically moving or reposition the containment system or barrier along the length of the object to be treated.

A still further object of the invention is to provide a containment system or barrier that can create a negative pressure within the enclosed treatment area, during use, so as to facilitate removal of any airborne media, dust, substance(s), material(s), contaminant(s), debris, hazardous material(s), etc., from the enclosed treatment area and thereby minimize the possibility of any blasting media and/or removed material(s), contaminant(s), debris, hazardous material(s), etc., escaping from the enclosed treatment area into the surrounding environment.

Yet another object of the invention is to provide a containment system that facilitates collection of the discharged blasting media and also facilitates collection, recycling and/or regeneration of the discharged blasting media, into a new blasting media, for reuse with the containment system.

A further object of the invention is to provide the operator of the blasting device or equipment with a substantially greater range of motion to assist with faster, better and improved treatment of the object to be treated.

A still further object of the invention is to utilize moisture, during the surface treatment process, to control and minimize the generation or creation of dust, e.g., apply vapor or moisture to the blasting media immediately before or as the blasting media is discharged by the surface treatment equipment.

Yet another object of the invention is to define, with the rigid support panel, a relatively small enclosed treatment area in which a negative pressure can be easily created and maintained, during the surface treatment process, so as to minimize the possibility of any blasting media and/or removed material(s), contaminant(s), debris, hazardous material(s), etc., from escaping the enclosed treatment area into the surrounding area.

Another object of the invention is to utilize at least partially translucent panels, to define the containment system or barrier, which permit light to pass therethrough and illuminate the object to be treated and thereby minimize the problems associated with adequately illuminating the object to be treated during the surface treatment process.

The present also relates to a treatment and containment system for treating an elongate object to be treated, the treatment and containment system comprising: surface treatment device for treating a portion of the elongate object to be treated; a housing for defining an enclosed treatment area and separating the enclosed treatment area from an operator of the surface treatment device, and the housing being opened at opposed ends thereof; each opposed opened end of the housing accommodating a pair of movable doors for respectively sealing against an exterior surface of a desired portion of the elongate object to be treated and thereby closing each opposed opened end of the housing when the pairs of doors are in a closed position sealed against the exterior surface of the elongate object to be treated; the housing having an access aperture therein through which the surface treatment device passes and communicates with the enclosed treatment area, and the access aperture facilitates manipulation of the surface treatment device within the housing; and a transparent viewing aperture for facilitating viewing by the operator of the elongate object to be treated.

The term "air tight seal", as generally used within this patent application and the appended claims, is intended to mean that the seal may allow a minimal amount of air to flow into the enclosed treatment area of the containment system or barrier but generally prevents any media, contaminant(s), dust and/or debris from flowing out of or escaping the enclosed treatment area past the seal into the surrounding environment.

BRIEF DESCRIPTION OF THE DRAWINGS

The invention will now be described, by way of example, with reference to the accompanying drawings in which.

DETAILED DESCRIPTION OF THE INVENTION

Figure 1:
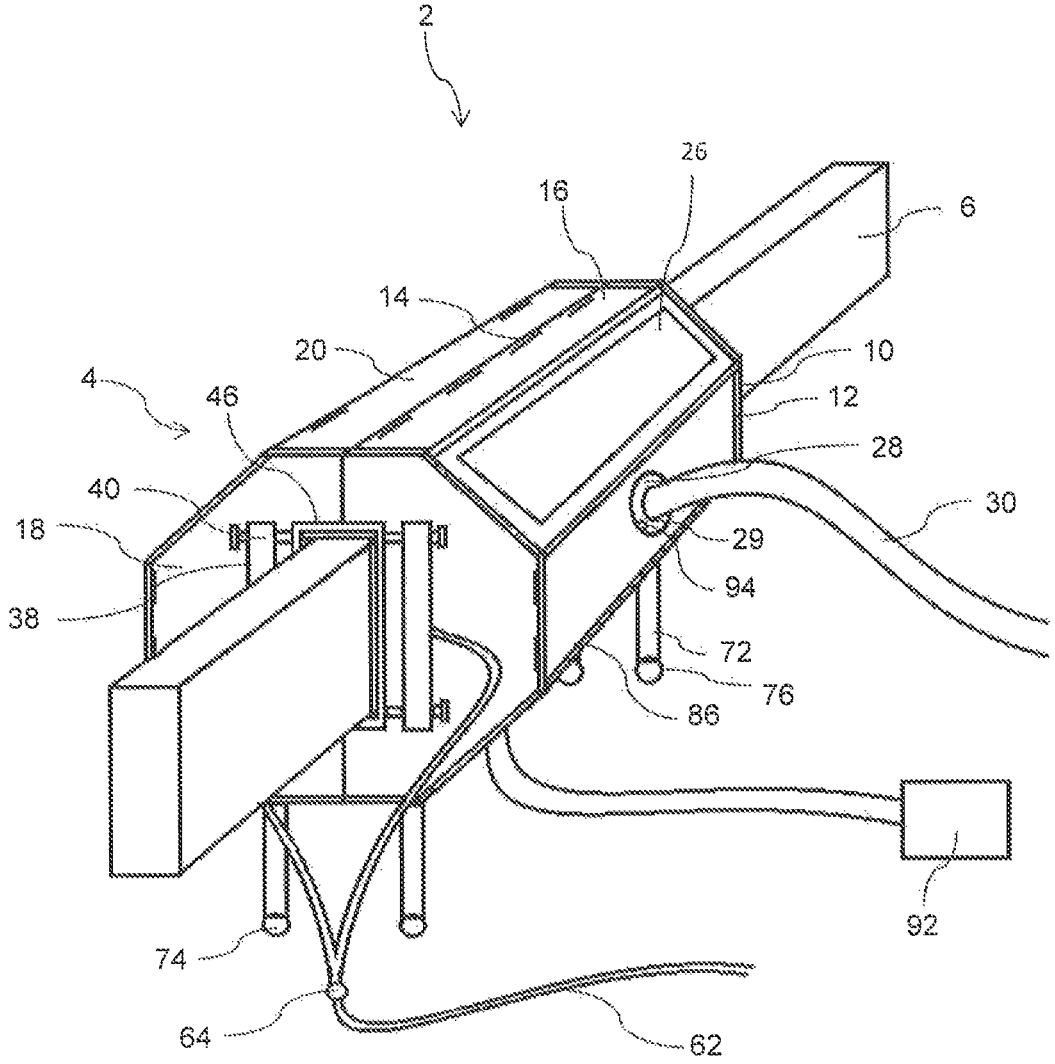
FIG. 1 is a diagrammatic perspective view of a first embodiment of the containment system or barrier according to the present invention.

Turning now to FIG. 1, a brief description concerning the various components of the present invention will now be briefly discussed. As can be seen in this embodiment, the portable containment system or barrier 2 generally comprises a housing 4 which completely surrounds a desired elongate segment or section of the object 6 to be treated. A plurality of frame members 10 (not shown in detail), e.g., typically manufactured from a lightweight metal, such aluminum, are integrally and permanently interconnected with one another 12, e.g., either by welding, and a pivotable connection 14, e.g., hinges. A plurality of (typically rigid) panel members 16, 18 are secured to inwardly facing surfaces of the frame members 10. Together, the frame members 10 and the panels 16, 18 form a substantially rigid and permanent structure which defines the housing 4.

These panel members 16, 18 are each preferably translucent so as to facilitate the passage of light therethrough and illumination of the object 6 to be treated. The translucent panel members 16, 18 typically provide adequate illumination into the enclosed treatment area. However, it is also envisioned that additional illumination, e.g., one or more lights, might be installed within the interior of the housing 4 so as to provide additional illumination to the enclosed treatment area when the object 6 is being treated.

The housing 4 typically comprises at least three walls, e.g., first and second opposed end walls and at least one side wall 16, which are all joined together with one another to complete formation of the housing 4. However, it is to be appreciated that the housing 4 may have more than three walls 16. For example, the embodiment shown in FIG. 1 comprises a housing 4 which has ten interconnected planar walls comprising of two opposed end walls or panels 18, and eight side walls 16. Together, the side and end walls or panels 16, 18 are interconnected with one another to form, along with the frame members 10, the housing 4 and define an enclosed treatment area, which is sealed, in an air tight manner, with respect to the external environment, for accommodating a section of the object 6 to be treated. It should be noted that the walls or panels 16, 18 may not be planar, and indeed, it is possible for the walls to have a radius of curvature, or any other desired shape, so as to constitute a substantially cylindrical containment unit.

According to one embodiment of the present embodiment, the containment unit 2 is constructed as two separate mating halves which, when mated together, form the housing 4 and define the enclosed treatment area. For example, one or more hinges 14 may be provided along the portion of two adjacent panels 16 while a releasable connection (not shown in detail) is provided on the lower most portion of two other adjacent panels 16 of the containment system or barrier 2 to facilitate locking the containment system or barrier 2 in the closed configuration, as generally shown in FIG. 1.

Both opposed ends of the containment system or barrier 2 are typically partially closed by the frame/panel 18 of the housing 4 so as to partially close each opposed end wall of the containment system or barrier 2. Additionally, both opposed ends of the containment system or barrier 2 are also partially open so as to permit opposed ends of the elongate object 6 to be treated, such as an I-beam, an elongate pipe, rod, shaft, pole, rail, railing, or other some other elongate member or structures, to extent out through opposed ends of the containment system or barrier 2. In order to sealingly close both of the opposed ends of the containment system or barrier 2, a pair of mating movable doors 38 are provided. The pair of mating movable doors 38 both have an opened position, in which the doors 38 are spaced from the object 6 to be treated, and a closed position, in which the doors 38 sealingly engage with the object 6 to be treated. Movement of each one of the doors 38, into their opened or closed positions, is controlled by a suitable piston mechanism 40, such as a hydraulic or a pneumatic mechanism 40, see FIGS. 2A and 2B, or a combined hydraulic/spring mechanism 40 or pneumatic/spring mechanism 40, which is discussed below in further detail.

In this way, the enclosed treatment area is generally enclosed so that, as the object 6 is treated with media, all of the discharged media, removed debris and/or other contaminates, such as paint, oil, grease, rust, oxidation, corrosion, etc., are completely confined within the enclosed treatment area and thus are prevented from rebounding and/or escaping into the surrounding environment. By completely enclosing a desired portion of the object 6 to be treated within the enclosed treatment area, this also facilitates collection of all of the utilized blasting media as well as collection of all of the removed substance(s), material(s), contaminant(s), hazardous material(s), debris, etc., within a relatively confined area by a collection device, such as a vacuum. As is known in the art, the collected blasting media, contaminates and/or debris can then be collected and conveyed to a recycling system or mechanism 92 where the recyclable blasting media is removed and separated from the contaminates and/or debris so that the recyclable blasting media can then be subsequent recycled and regenerated for subsequent reuse while the contaminates and/or debris can be properly disposed of in a conventional manner.

In the embodiment of FIG. 1, one of the side panels 16 contains a viewing aperture which, as shown in this embodiment, is generally rectangular in shape, e.g., has a width of between 6-48 inches or so and a length of between 6-48 inches or so. A transparent window 26, e.g., a piece of glass or plexiglass, is sealingly accommodated within the viewing aperture so as to separate the enclosed treatment area from the surrounding environment while still permitting viewing of the treatment activities occurring within the treatment area.

The transparent window 26 is normally located adjacent to, but spaced slightly from, a spherical orb 28 or some other surface treatment port which allows the surface treatment equipment 30 to pass freely through the housing 4 and communicate with the enclosed treatment area.

Preferably, the fine mesh screen, or some other substantially transparent barrier is located between the transparent window 26 and a remainder of the enclosed treatment area. The fine mesh screen is located so as to minimize the amount of media and other debris which may be permitted to directly impact against the inwardly facing surface of the transparent window 26, during operation, and scratch and/or other damage the transparent window 26.

Another side panel 16, preferably located closely adjacent the transparent window 26, supports the spherical orb 28 or some other surface treatment port. The spherical orb 28 or some other surface treatment port has a centrally located aperture 29 therein. This orb/aperture facilitates introduction of a desired surface treatment tool 30 therethrough and into the surface treatment area to facilitate the desired surface treatment of the object 6 to be treated. As a result of this arrangement, the operator is able utilize and introduce virtually any desired surface treatment tool 30 inside the containment area without also being subjected to any hazardous conditions therein. A further detailed description and discussion concerning the features of the spherical orb 28 can be found in U.S. Pat. No. 8,556,683 and the disclosure and teaching of that reference are herein incorporated by reference in their entirety.

Preferably, the aperture 29 formed within the orb 28 is adequately sized such that the leading end of the surface treatment device 30 can be inserted into and withdrawn from the aperture 29 while, at the same time, the exterior surface of the surface treatment device 30 and the inwardly facing surface of the aperture 29 prevent the escape or discharged and airborne media, dust, contaminates and/or debris from exiting through the aperture 29 into the surrounding environment. In order to seal such interface, a perimeter seal may be provided around the opening of the aperture 29, formed in the inwardly facing surface of the spherical orb 28, to facilitate sealing of the surface treatment device 30 as the surface treatment device 30 passes through the aperture 29 and enters the enclosed treatment area.

Such seal also permits the operator to insert and move the surface treatment device 30 to and fro, relative to the aperture 29, to control the spacing of a leading tip of the surface treatment device 30 from the surface or the object 6 to be treated while also permitting removal of the surface treatment device 30 from the aperture 29. If desired, the spherical orb 28 may be provided with a knob, a steering wheel or some other control and/or manipulation device 94 which facilitates control and/or manipulation of the spherical orb 28 by the operator.

A leading end of each one of the doors 38 has a desired sealing profile which is shaped, sized and contoured so as closely follow the profile of the exterior surface of the object 6 to be treated. The inwardly facing leading end of each one of the doors 38 typically supports a relatively thick resilient member 46, such as foam, rubber or some other spongy/resilient component, which facilitates achieving a substantially air or fluid tight seal between the relatively thick resilient member 46 and the exterior surface of the object 6 to be treated, when both of the mating pair of doors 38 are moved into their closed position—see FIG. 2A.

That is, as the pair of cooperating doors 38 move toward one another into their closed positions in order to close the opening formed adjacent one of the housing 4, each door 38 is moved to a location closely adjacent the exterior surface of the object 6 to be treated thereby causing the resilient member 46 to intimately and sealingly engage with the exterior surface of the object 6 to be treated. Such sealing engagement seals the external environment from the surface treatment area so as to prevent the escape of any media, contaminant(s), dust and/or debris through the formed seal. The resilient material 46 typically has a thickness of between about 1 inch to about 4 inches or so and a width of between about 1 inch and about 5 inches or so. It is to be appreciated that the thickness and the width of the sealing material 46 can vary, from application to application, without departing from the spirit and scope of the present invention.

If desired, the containment system or barrier 2 may be supported by conventional adjustable framework which facilitates raising and lowering a vertical height of the containment system or barrier 2 to adjust a relative height of the two opposed openings of the containment system or barrier 2 relative to the object 6 to be treated. For example, a lower portion of most, if not all, of each frame support 72 may support at least one lockable wheel or roller 74 which facilitates moving or rolling the framework of the housing 4 to and fro along the floor or some other support surface and repositioning of the containment system or barrier 2 in a desired orientation, as necessary, by locking the wheels or rollers via an associated lock (not shown in detail).

Figure 2A:
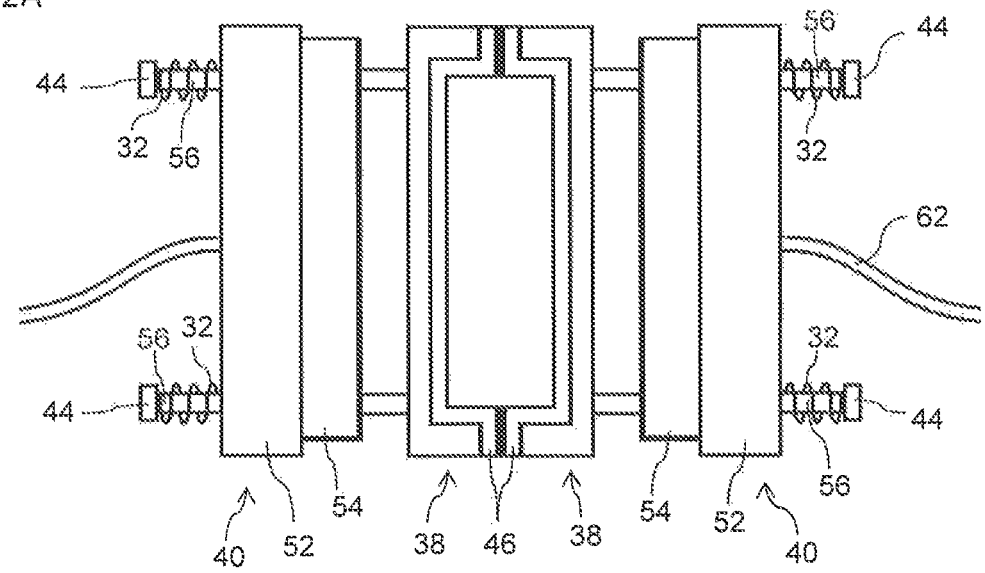
FIGS. 2A and 2B are diagrammatic front elevational views showing the piston mechanism which facilitates opening and closing the doors.
Figure 2B:
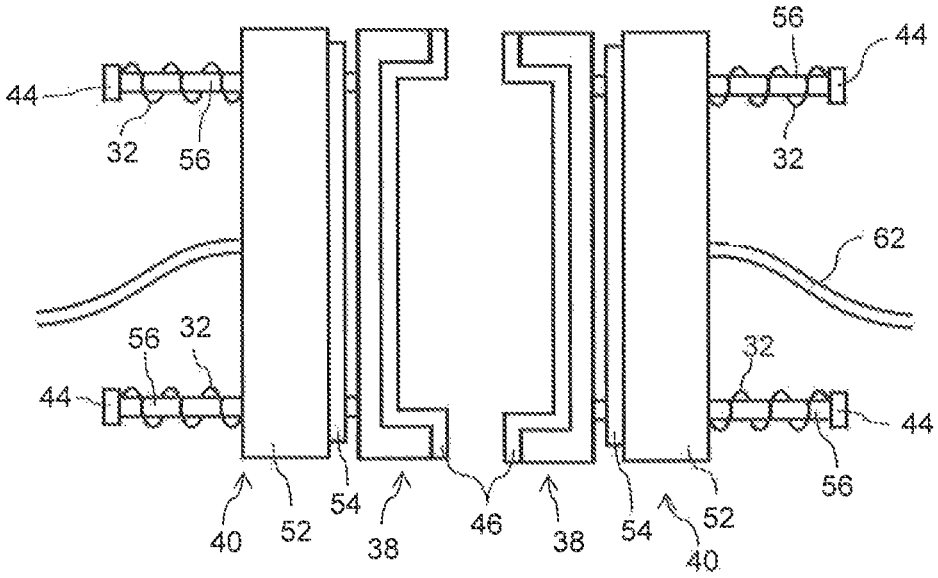

Once a desired portion of the object 6 to be treated has been treated, both of the pairs of doors 38 are pivoted or otherwise moved into their opened positions, as shown in FIG. 2B, sufficiently spaced from both the housing 4 and the object 6 to be treated. Thereafter, the containment system or barrier 2 is slide, conveyed, transported or otherwise repositioned or moved axially along the elongate the object 6 to another untreated section of the object 6 to be treated. Once the containment system or barrier 2 is suitably position, both of the pairs of doors 38 are then moved/pivoted/slid into their closed positions in intimate and sealing engagement with the exterior surface of the object 6 to be treated and the sealing gasket or member 80 surrounding the perimeter of the opening. This new section of the object 6 to be treated is now sealingly contained within the containment system or barrier 2 so that the desired surface treatment of the object 6 to be treated can now occur. Once this new section of the object 6 to be treated is adequately treated, the above process is repeatedly repeated until the object 6 to be treated is completely treated.

As generally shown in FIGS. 2A through 3C, each one of a pivotable doors 38 is supported by a piston mechanism 40. A base portion 52 of the piston is fixedly supported by the frame 10 while the movable cylinder portion 54 of the piston 40 is (releasably) coupled to one of the movable door 38. A first end of a pair of threaded rods 56 is secured to the movable cylinder portion 54 at spaced apart locations from one another, while the free ends of the each of the pair of threaded rods 56 extends through a respective opening in the fixed base portion 52 of the piston 40 and out through the opposite side of the base portion 52. A spring 32, such as a compression spring, facilitates biasing the movable cylinder portion 54 toward the fixed base portion 52 and normally retaining the door 38 in its opened position. In FIGS. 2A-2B, the spring 32 is supported by the remote free end of each one of the threaded rods 56 and a threaded nut 44 facilitates captive retaining the compression springs 32 on the threaded rods 56.

An inflatable bladder 60 is captively located between the movable cylinder portion 54 and the fixed base portion 52 of the piston 40 for biasing the supported door 38 into its closed positions. As the inflatable bladder 60 is inflated with a suitable fluid (e.g., pressurized air), the inflatable bladder 60 expands and biases the movable cylinder portion 54 away from the fixed base portion 52 and thereby facilitates closing the door 38. As such movement occurs, the compression springs 32 becomes each compressed, e.g., becomes "loaded." The above-described arrangement provides limited relative movement between the movable cylinder portion 54 and the fixed base portion 52 for retracting and closing the associated door 38. Both of the mating pair of doors 38 are coupled to the same pressurized fluid source 62 and controlled by the same valve mechanism 64 (see FIG. 1) so that both of the mating doors 38 are substantially simultaneously opened and closed with one another.

Figure 3A:
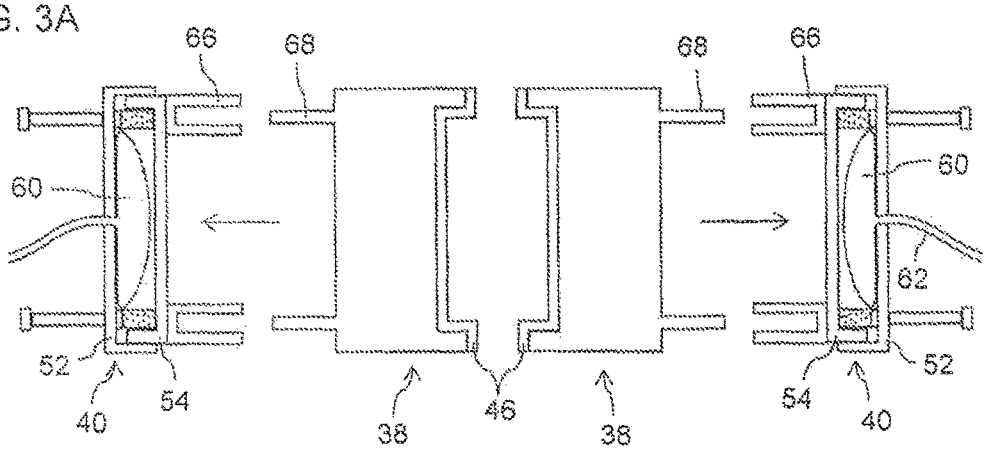
FIGS. 3A-C are diagrammatic partial cross sectional views showing the interaction of the piston mechanisms and the doors of FIG. 1 with FIG. 3A showing an open position, FIG. 3B showing an intermediate position and FIG. 3C showing a closed position of the doors.
Figure 3B:
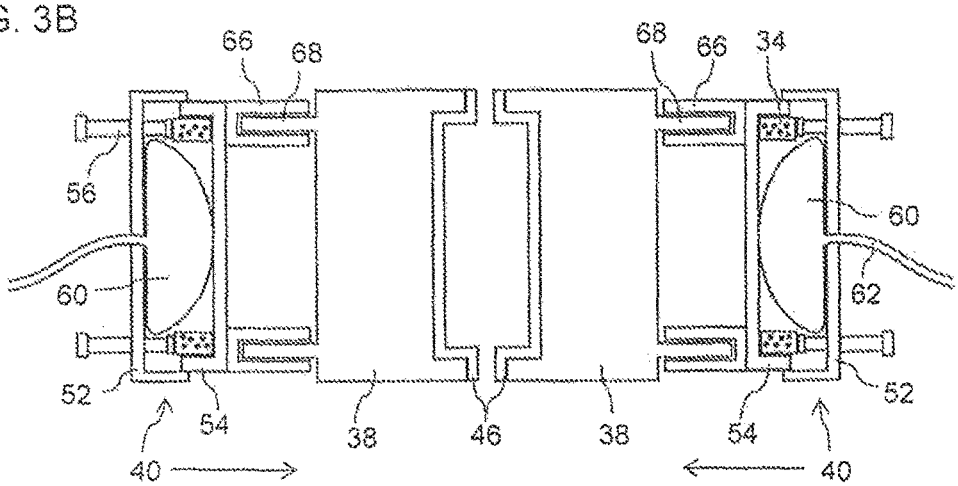
Figure 3C:
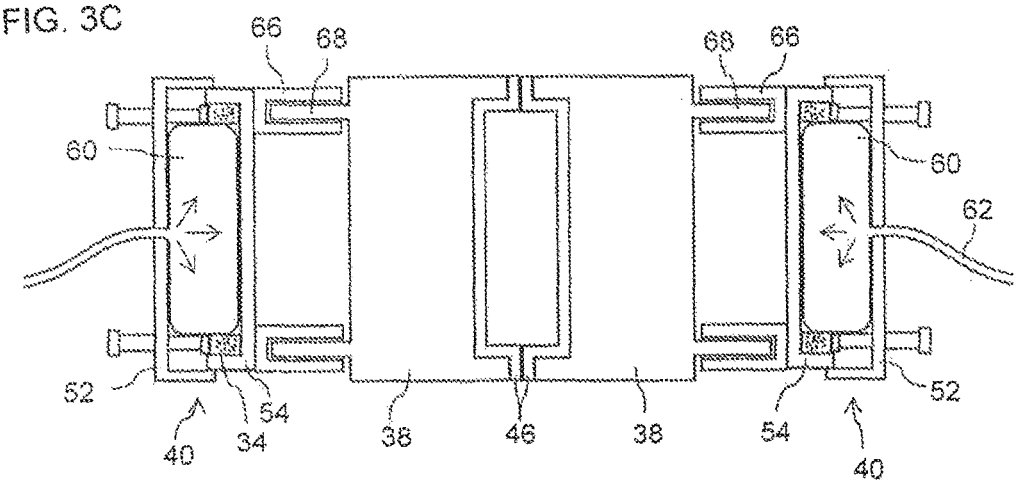

As diagrammatically illustrated in FIGS. 3A-3C, a surface of the movable cylinder portion 54, remote from the fixed base portion 52 of the piston 40, supports a pair of spaced apart female coupling members 66 while each of the doors 38 supports a mating pair of male coupling members 68. The male coupling members 68 are shaped, sized and aligned so as to be captively received and retained by the female coupling members 66 and thereby facilitate releasable coupling and decoupling of each door 38 from the respective movable cylinder portion 54. The mating male and female coupling members 66, 68 facilitate quick and easy replacement of the doors 38 so that a variety of different type/shaped doors 38 can be quickly and easily coupled to the female coupling members 66 to facilitate adaptation of the containment system or barrier 2 to a variety of different surface treatment applications.

For example, FIG. 3A illustrates two doors 38 being mounted the containment system or barrier 2. If the right side door 38, shown in FIG. 3A, is moved toward the left, as shown in that drawing, the male coupling members 68 can be slid away from and become completely separated and disconnected from the female coupling members 66. Thereafter, the removed door 38 can be replaced with a new door 38, which has a desired sealing profile which is designed to intimately engage with the contour of the exterior surface of the next object 6 to be treated. The above process is then repeated for the other door 38 to replace that door with a new door 38 which also has a desired sealing profile which is designed to intimately engage with the contour of the exterior surface of the next object 6 to be treated.

Figure 4:
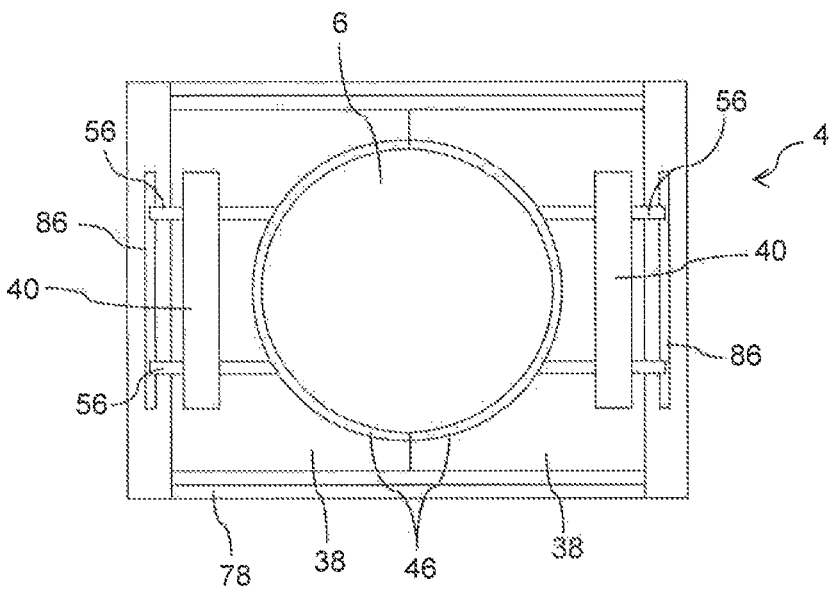
FIG. 4 is a diagrammatic front elevational view of an alternative embodiment of the pair of doors supported by a pair of spaced apart horizontal hinges.

As generally shown in FIG. 4, this door 38 has a sealing profile with a radius of curvature of approximately 48 inches. The resilient material 46 is supported along the inwardly facing surface thereof, typically by an adhesive or some other conventional fastening technique or mechanism which securely retains the resilient material 46 along the inwardly facing surface of the sealing profile of the door. This door is designed to sealingly engage with a pipe, rod or some other elongate cylindrical member which has an external diameter of between 45-47 inches, for example.

Figure 5:
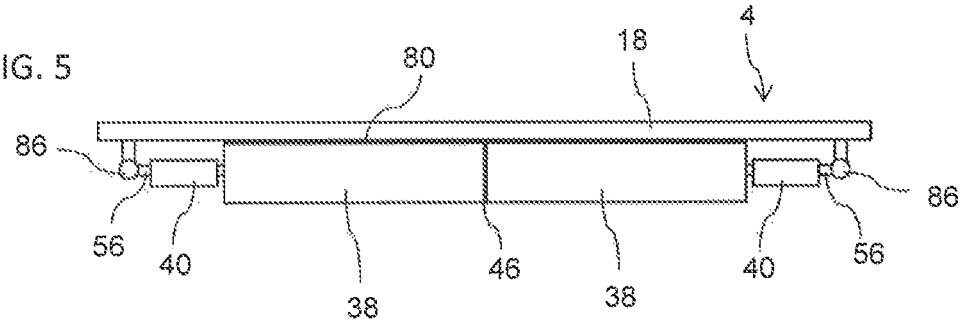
FIG. 5 is a diagrammatic view top elevational view of FIG. 4 with the doors shown in the closed position.
Figure 6:
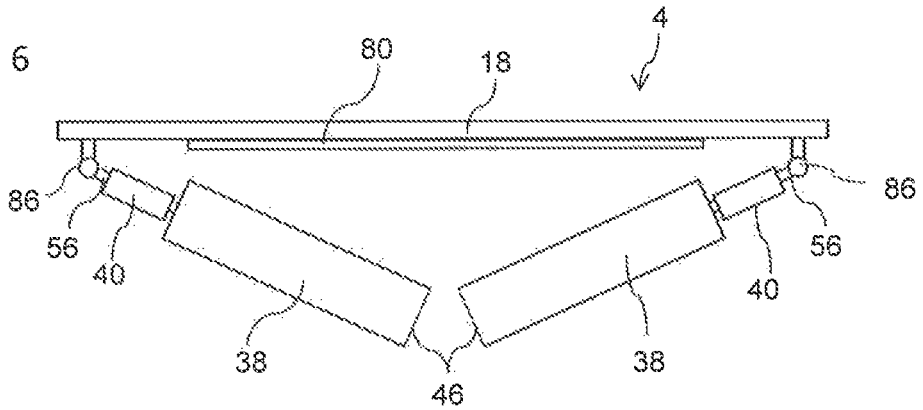
FIG. 6 is a diagrammatic top elevational view of FIG. 4 showing the door pivoted about the pair of horizontal hinges into a partially open position.

As illustrated in FIGS. 4-6, according to this embodiment, a portion of the fixed base portion 52 of each piston 40 is hingedly connected to the housing 4 by a vertical (or possibly a horizontal) extending hinge 86, for example. As a result of such arrangement, the piston mechanism 40 and the door 38 are both supported but pivotably movable relative to the housing 4. Such outward pivoting movement of both of the doors 38, when reposition the containment system or barrier 2 is desired, is generally illustrated in FIG. 6. When the doors 38 are pivoted into their closed position, as illustrated in FIG. 5, they are located closely adjacent one another with the inwardly facing surface of each one of the doors 38 in abutting engagement with the respective sealing gasket or member 80, surrounding the perimeter of the opening of the housing 4, and the associated resilient material 46 of each door 38 in sealing engagement with object 6 to be treated so as to achieve an air/fluid tight seal between opening of the housing 4, the object 6 to be treated and the doors 38. The housing 4 may be provided with conventional upper and lower latch mechanisms (not shown) which temporarily lock and facilitate retaining both pairs of doors 38 in their closed positions so as to maintain the fluid tight seal between opening and the respective door 38.

Figure 7:
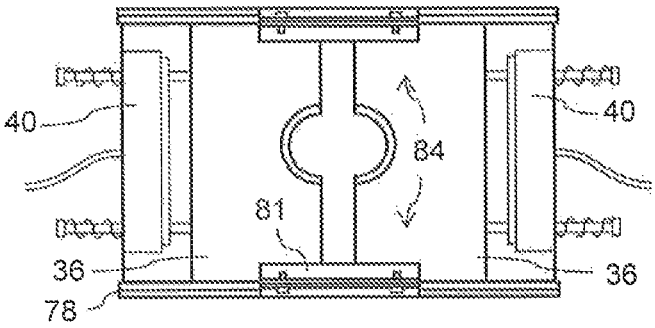
FIG. 7 is a diagrammatic front elevational view of another embodiment showing the doors moving along a pair of upper and lower guide tracks into an opened position.
Figure 8:
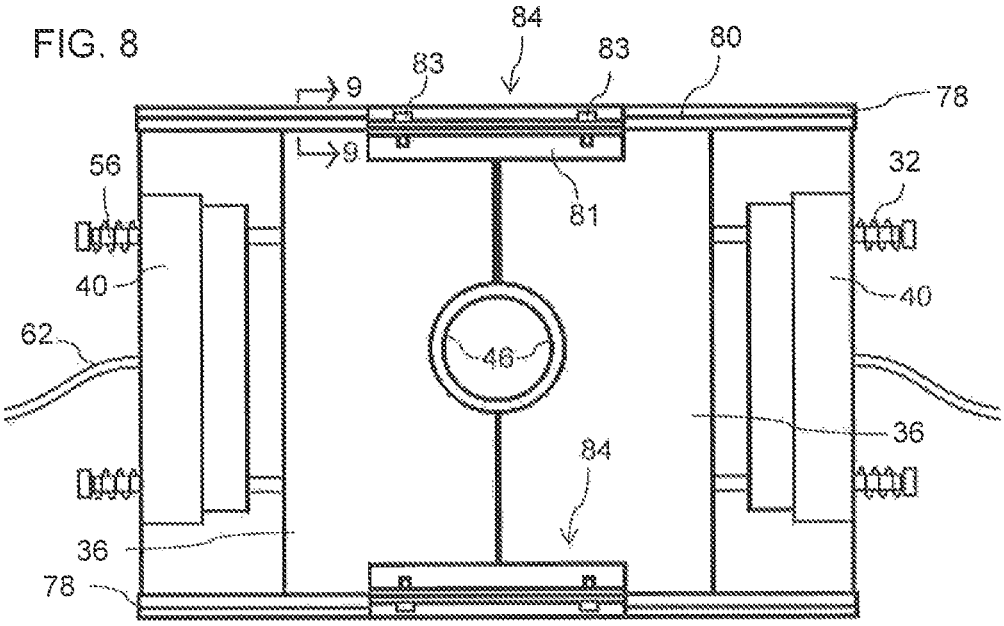
FIG. 8 is a diagrammatic front elevational view showing the doors, of FIG. 7, shown in a closed position.
Figure 9:
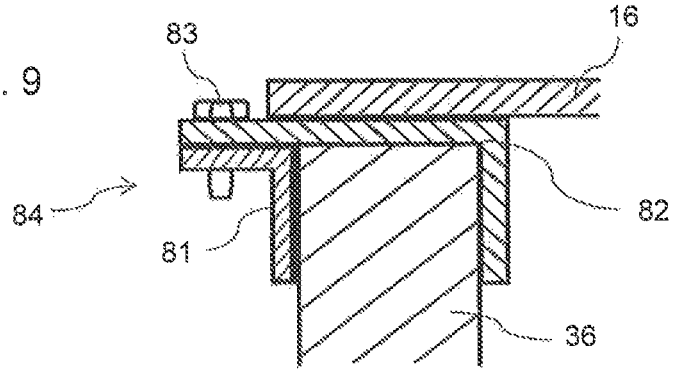
FIG. 9 is a diagrammatic cross sectional view, taken along section line 9-9 of FIG. 8, showing the release mechanism of FIGS. 7 and 8.

As generally shown in FIGS. 7-9, the pair of doors 36 has a sealing profile with a radius of curvature of 12 inches. Again, the resilient material 46 is supported along the inwardly facing surface thereof, typically by an adhesive or some other conventional fastening technique or mechanism which securely retains the resilient material 46 along the inwardly facing surface of the sealing profile of the door 36.

The doors 36 shown in FIGS. 7 and 8 are designed to sealingly engage with a pipe, rod or some other cylindrical member which has an external diameter of between 9½ and 11 inches, for example.

As diagrammatically illustrated in FIGS. 7-9, each pair of mating doors 36 is supported by and movable along a pair of upper and lower guide tracks 78. As a result of such arrangement, both doors 36 lie substantially within a plane and the associated piston members 40 of the respective doors 36, facilitate moving or conveying the doors 36 into either their opened or closed positions. An outwardly facing surface of the perimeter of each opening supports a sealing gasket or member 80 which is designed to engage and slide against the inwardly facing surface of the door 36. This sealing gasket or member 80 surrounds the entire perimeter of the opening in the housing 4 facilitates achieving a fluid tight seal between the perimeter of the opening of the housing 4 and the respective door 36. A portion of either the top rail or the bottom rail of the guide track 78 may be removable so as to facilitate replacement of one or both of the doors 36.

As shown in FIGS. 7-9, to facilitate easy replacement of one of the doors 36, at least one of the top and the bottom guide rails 78 (the top guide rail in this instance) has a removable section 81. When the removable section 81 is removed, e.g., by loosening and removing the fastener(s) 83 and, thereafter, removing the removable section 81 from a remainder of the top guide rail 78, the door 36 is accessible and can be slid to either the left or the right, depending upon which door 36 is to be replaced first. As soon as the male and the female coupling members 66, 68 become separated from one another, the door 36 can be pivoted away from a remained of the top guide rail 78 and, thereafter, the removed from both the top and the bottom guide rails 78 and replaced with a new door having a desired sealing profile. Next, the replaced door is then slid toward either the left or the right, depending upon which door 36 was replaced, in order to engage the male and the female coupling members 66, 68 with one another. The above process is then repeated to replace the other door. Lastly, the removable section 81 is reinstalled by the fastener(s) 83.

Turning next to FIGS. 10-13, this embodiment comprises a pair of opposed end panels 18 which each define an opening in the housing 4 that is specifically designed to closely surround and enclose a portion of an object 6, e.g, an I-beam in this instance, to be treated. Similar to the doors 36, 38 of previous embodiments, each one of the mating doors 102 is controlled by a hydraulic or a pneumatic mechanism 40, as described above, from a side thereof remote and spaced from the I-beam. However, due to the unique surface profile of the I-beam, each one of the doors 102 have a mating inward facing profile which is designed, in combination with the resilient material 46, to completely encompass and seal against the unique exterior surface profile of the I-beam 6.

In order to close the door 102, an outer sleeve 104 is either hydraulically or pneumatically driven. The outer sleeve 104 is coupled to the central shaft 110 by a spring (e.g., a compression spring 105, for example, shown is dashed lines), which allows some relative movement between the outer sleeve 104 and the central shaft 110 as soon as the supported central section 108, of the central shaft 110, abuts against the I-beam 6, as discussed below. The spring 105 ensures that the doors 102 normally remain in the position generally shown in FIGS. 10 and 12.

According to this embodiment, each of the doors 102 comprises a central section 108 and a pair of outer sections 106 which are each hingedly connected, along an opposed end of the central section 106, by a conventional pivot or hinge (not numbered). The conventional pivot or hinge permits each of outer sections 106 to pivot or move relative to the central section 108, during closing of the door 102.

Figure 10:
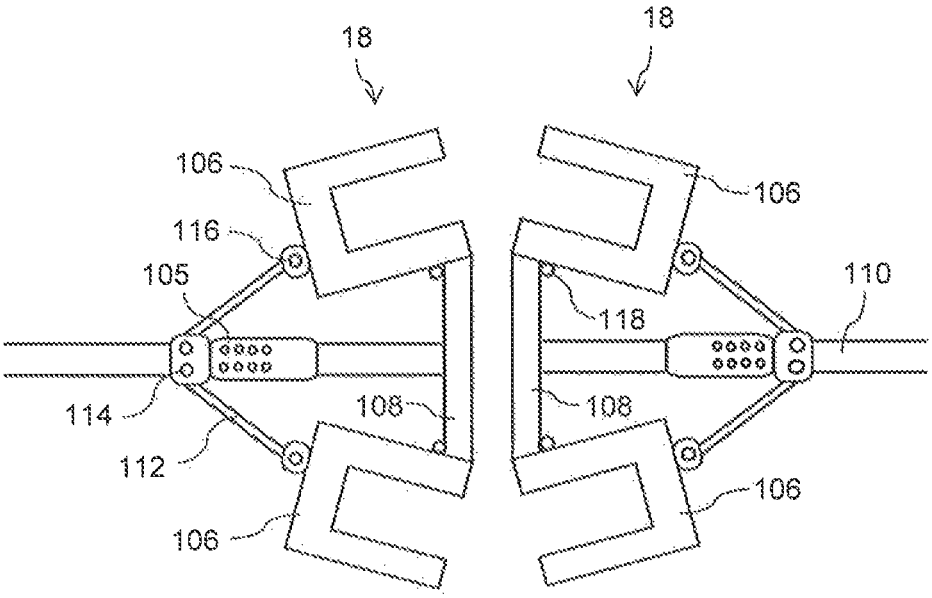
FIG. 10 is a diagrammatic front elevational view showing a further embodiment of the doors, in an opened position, which are suitable for sealingly engaging with an I-beam to be treated.
Figure 11:
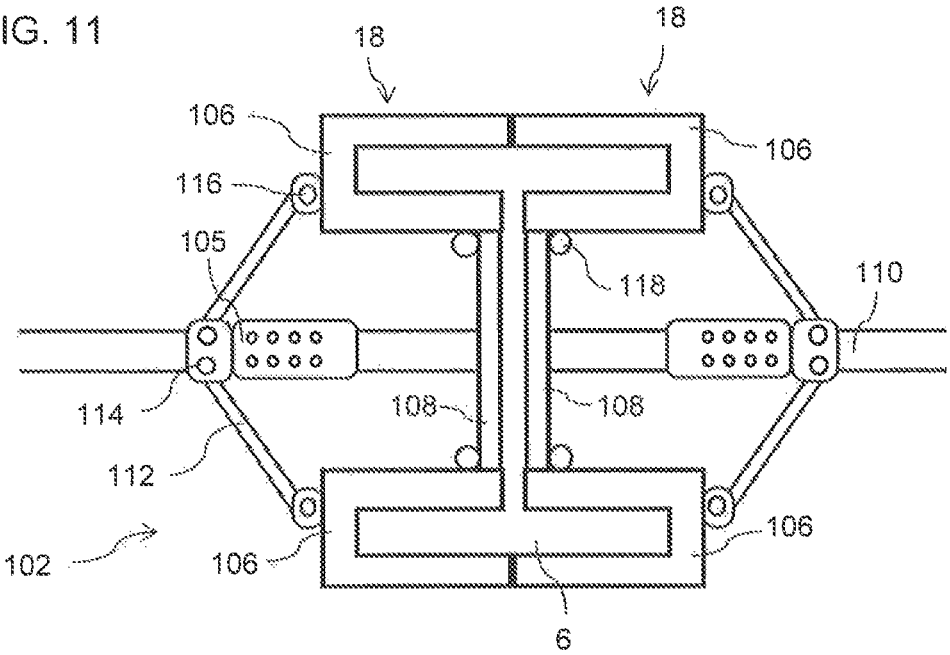
FIG. 11 is a diagrammatic front elevational view showing the embodiment of FIG. 10 in the closed position, sealingly engaged with the I-beam to be treated.
Figure 12:
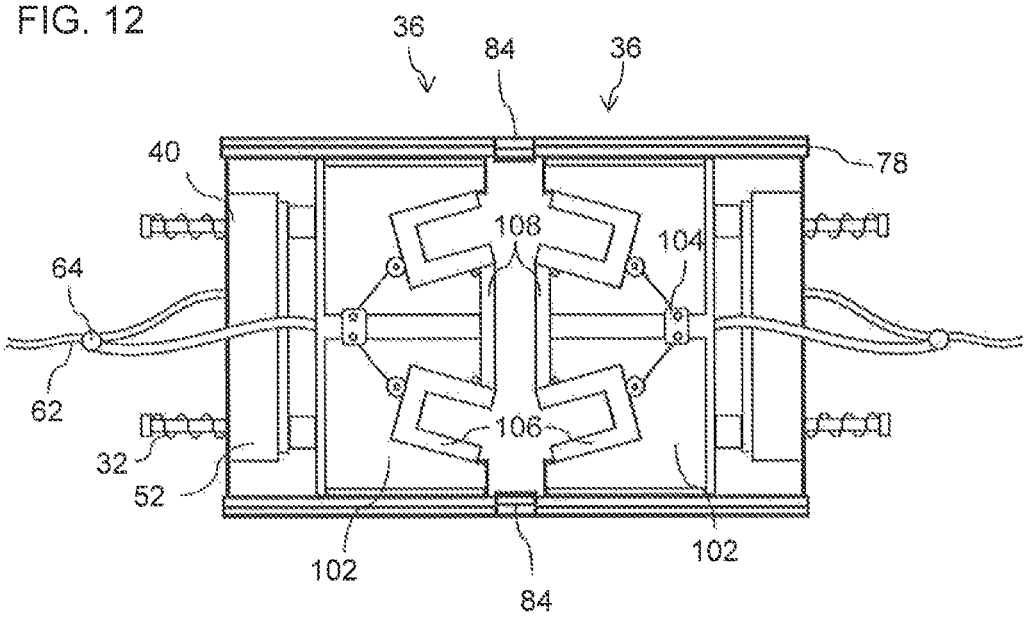
FIG. 12 is a diagrammatic front elevational view showing the embodiment of FIGS. 10 and 11 used for sealing the open end of the portable containment system or barrier.

As the pair of doors 102 are closed and moved toward one another by driving the outer sleeve 104 (e.g., by the supplied hydraulic or pneumatic pressure) toward one another, the doors 102 normally remain in their unpivoted positions, as generally shown in FIGS. 10 and 12. As soon as the two central portions 108 abut against a central portion of the I-beam 6 and the central portions 108 and the central shaft s110 can no longer continue moving toward one another. Thereafter, each of the outer sections 106 commence pivoting about and relative to the central section 108, and the springs 105 starts permitting relative movement between the outer sleeve 104 and the central shaft 110. As this occurs, any further movement of the outer sleeve 104 (e.g., by the supplied hydraulic or pneumatic pressure), pivots the outer sections 106 relative to the central section 108. Each of the outer sections 106 continue pivoting relative to the central section 108 until the doors 102 reach the position generally shown in FIGS. 11 and 13, and the doors 102 completely seal against the I-beam 106. In order to open the doors 102, the above procedure occurs in the reverse order.

Figure 13:
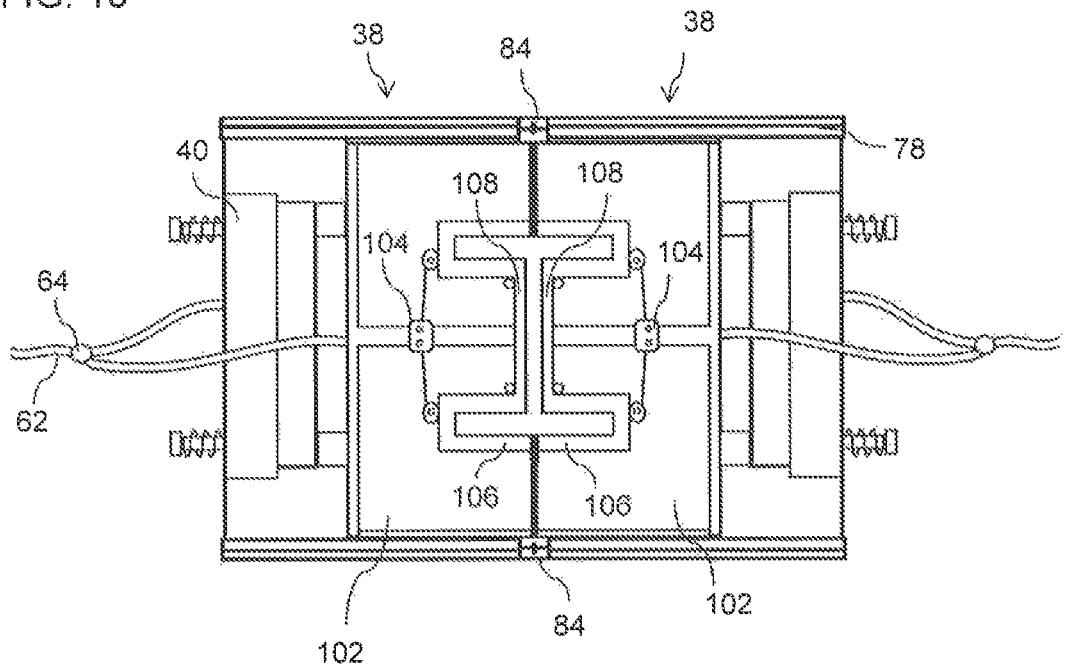
FIG. 13 is a diagrammatic front elevational view showing the embodiment of FIG. 12 in a closed position for sealing the open end of the portable containment system or barrier.

FIGS. 12 and 13 diagrammatically illustrates the doors 102, of FIGS. 10 and 11, incorporated as part of a containment system or barrier 2, e.g., FIG. 12 diagrammatically illustrates the doors 102 in their opened position, while FIG. 13 diagrammatically illustrates the doors 102 in their closed position. In the embodiment of FIGS. 12 and 13, the doors 102 each have male coupling members 68 which interconnect with the previously discussed female coupling members 66 of the piston mechanism 40. In this way, the doors 102 are efficiently interchangeable with virtually any other desired door having the desired sealing profile.

For each of the previously discussed embodiments, the containment barrier may also include an automatic safety shutoff feature which generally includes a pressure sensor that is located within the treatment area. The pressure sensor can be supported by any of the containment barrier components or merely located within the treatment area. The pressure sensor is coupled to a control device which controls the supply of electrical power to the various surface treatment equipment and/or tools 30, such as the surface treatment device 30. The pressure sensor continually monitors the atmospheric pressure within the treatment area and provides and input signal, indicative of the atmospheric pressure of the treatment area, to the control device.

The pressure sensor can be attached to any containment barrier component that is exposed to the treatment area so as to continually monitor the atmospheric pressure within the treatment area. In some instances, although the vacuum system may appear to be operating as normal, if for some reason the vacuum fails to pass a sufficient amount air through the filtration system, e.g., the filter is clogged or full, the pressure sensor will detect a pressure increase in the treatment area.

If the atmospheric pressure within the treatment area is not maintained at or below or above a desired pressure, e.g., a negative pressure of a few inches of water, for example, the pressure sensor will transmit a signal to the control device which interrupts the supply of electrical power to the desired surface treating device or equipment. This notifies the operator that there is a problem with the system, e.g., the filter must be serviced, a breached has occurred in the containment barrier, etc. The operator will the survey the situation and undertake suitable corrective action so that a desired (negative) pressure is again achieved within the treatment area. Thereafter, the vacuum system can then develop a desired pressure in the treatment area and the pressure sensor can then detect the same so that the control device can again permit the supply of electrical power to the desired blasting equipment.

As illustrated in the above embodiments, it is to be appreciated that the relative size of the containment system or barrier 2 depends on the particular application and can be varied from application to application. Typically, the containment system or barrier 2, according to the present invention, has a length which varies from a few feet to possibly 10 or 20 feet and is designed to minimize, to a certain extent, the volume the treatment area. However, it is to be appreciated that the volume of the treatment area must be sufficiently large so as not to hinder the desired surface treatment of the object 6 to be treated by the operator.

It is to be appreciated that the contour of the sealing profile of the doors 36, 38, 102 can vary from application to application without departing from the spirit and scope of the present invention. Generally, the sealing profile of the door will have a contour which closely follows and/or mirrors the exterior contour or perimeter of the object 6 to be treated. For example, if the object 6 to be treated has a square exterior contour, the sealing profile of the door will have a corresponding substantially square, but slightly larger, profile. A sufficient thickness of the resilient material 46 will be supported by and extend along the inwardly facing surface of the sealing profile so as adequately fill in all of the space located between inwardly facing surface of the sealing profile of the door and the exterior surface of the object 6 to be treated.

Alternatively, if the object 6 to be treated has a cylindrical, hexagonal, rectangular, etc., exterior contour, the sealing profile of the door will have a corresponding, but slightly larger, substantially cylindrical, hexagonal, rectangular, etc., profile which closely follows and/or mirrors the exterior contour or perimeter of the object 6 to be treated. A sufficient thickness of the resilient material 46 will be supported by and extend along the inwardly facing surface of the sealing profile so as adequately fill in all of the space located between inwardly facing surface of the sealing profile of the door and the exterior surface of the object 6 to be treated.

Once a desired portion of the object 6 to be treated has been treated, both of the pairs of doors are moved into their opened positions and spaced from the object 6 to be treated. Thereafter, the containment system or barrier 2 is slid, conveyed, transported or otherwise moved axially along a length of the elongate the object 6 to be treated to another section of the object 6 to be treated. Once the containment system or barrier 2 is suitably position, both of the pairs of doors are moved into their closed positions in intimate and sealing engagement with the exterior surface of the object 6 to be treated. This new section of the object 6 to be treated is now sealingly contained within the containment system or barrier 2 so that the desired surface treatment of the object 6 to be treated can now occur. Once this new section of the object 6 to be treated is adequately treated, the above process is again repeated.

Since certain changes may be made in the above described improved portable containment system, without departing from the spirit and scope of the invention herein involved, it is intended that all of the subject matter of the above description or shown in the accompanying drawings shall be interpreted merely as examples illustrating the inventive concept herein and shall not be construed as limiting the invention.

I claim:

1. A treatment and containment system for treating an elongate object to be treated, the treatment and containment system comprising:

a surface treatment device for treating a portion of the elongate object to be treated;

a housing for defining an enclosed treatment area and separating the enclosed treatment area from an operator of the surface treatment device, and the housing being opened at opposed ends thereof;

each opposed opened end of the housing accommodating a pair of movable doors which are supported by the housing and movable relative to one another and relative to the housing for respectively sealing against an exterior surface of a desired portion of the elongate object to be treated and, when the pairs of doors are in a closed position sealed against the exterior surface of the elongate object to be treated, thereby closing each opposed opened end of the housing;

the housing having an access aperture therein through which the surface treatment device passes and communicates with the enclosed treatment area, and the access aperture facilitates manipulation of the surface treatment device within the housing; and a transparent viewing aperture for facilitating viewing of the elongate object to be treated by the operator.

2. The treatment and containment system according to claim 1, wherein the housing and the pair of movable doors, when closed, completely surround a circumference of a desired elongate portion of the object to be treated, and the housing comprises at least one of frame members and a plurality of panels which form a substantially rigid and permanent housing.

3. The treatment and containment system according to claim 2, wherein at least one panel is translucent so as to facilitate the passage of light therethrough and illumination of the elongated object to be treated.

4. The treatment and containment system according to claim 2, wherein at least one hinge is provided along a portion of two first adjacent panels of the housing while a releasable connection is provided along a portion of two other adjacent panels of the housing to facilitate locking the housing in a closed configuration about the elongate object to be treated.

5. The treatment and containment system according to claim 1, wherein each of the pair of movable doors have an opened position, in which the moving doors are spaced from the one another and the elongate object to be treated, and a closed position, in which the movable doors sealingly engage against the exterior surface of the elongate object to be treated.

6. The treatment and containment system according to claim 5, wherein movement of each one of the movable doors, into the opened and the closed positions, is controlled by one of a piston mechanism, a combined hydraulic/spring mechanism and a pneumatic/spring mechanism.

7. The treatment and containment system according to claim 1, wherein a spherical orb is located within the access aperture to allow the surface treatment device to pass freely through the housing and communicate with the enclosed treatment area;

the transparent viewing aperture is located adjacent to, but spaced slightly from, the spherical orb; and a mesh screen is located between the transparent viewing aperture and a remainder of the enclosed treatment area and arranged so as to minimize an amount of media and debris which may be permitted to impact directly against an inwardly facing surface of the transparent window, during operation, and damage the transparent viewing aperture.

8. The treatment and containment system according to claim 7, wherein an orb aperture, formed within the orb, is sized such that a leading end of the surface treatment device can be inserted into and withdrawn relative to the orb while, at the same time, an exterior surface of the surface treatment device and the inwardly facing surface of the orb aperture prevent escape of airborne media, dust, contaminates and/or debris through the orb aperture into a surrounding environment.

9. The treatment and containment system according to claim 1, wherein a leading end of each one of the movable doors has a sealing profile which is contoured so as closely follow the exterior surface of the elongate object to be treated, and the leading end of each one of the movable doors supports a resilient member which facilitates achieving a substantially air tight seal between the resilient member and the exterior surface of the elongate object to be treated, when both of the mating pair of movable doors are in the closed position.

10. The treatment and containment system according to claim 9, wherein the resilient material has a thickness of between about 1 inch to about 4 inches and a width of between about 1 inch and about 5 inches.

11. A treatment and containment system for treating an elongate object to be treated, the treatment and containment system comprising:

a surface treatment device for treating a portion of the elongate object to be treated;

a housing for defining an enclosed treatment area and separating the enclosed treatment area from an operator of the surface treatment device, and the housing being opened at opposed ends thereof;

each opposed opened end of the housing accommodating a pair of movable doors for respectively sealing against an exterior surface of a desired portion of the elongate object to be treated and thereby closing each opposed opened end of the housing when the pairs of doors are in a closed position sealed against the exterior surface of the elongate object to be treated;

the housing having an access aperture therein through which the surface treatment device passes and communicates with the enclosed treatment area, and the access aperture facilitates manipulation of the surface treatment device within the housing;

a transparent viewing aperture for facilitating viewing of the elongate object to be treated by the operator;

wherein the treatment and containment system is supported by an adjustable framework which facilitates raising and lowering a vertical height of the treatment and containment system relative to a height of the elongate object to be treated; and the framework includes at least one lockable wheel or roller which facilitates moving or rolling the framework of the housing to and fro along a support surface and repositioning of the treatment and containment system in a desired orientation, as necessary, by locking the wheels or rollers via an associated lock mechanism.

12. The treatment and containment system according to claim 1, wherein each one of the movable doors is supported by a piston mechanism, a base portion of the piston is fixedly supported by the housing while the movable cylinder portion of the piston is coupled to one of the movable door, a first end of a pair of threaded rods is secured to the movable cylinder portion at spaced apart locations from one another, while free ends of the each of the pair of threaded rods extends through a respective opening in a fixed base portion of the piston and out through the opposite side of the base portion, a spring facilitates biasing the movable cylinder portion toward the fixed base portion and normally retaining the movable door in the opened position, and the spring is supported by a remote free end of each one of the threaded rods and a threaded nut facilitates captive retaining the springs on the threaded rods.

13. The treatment and containment system according to claim 12, wherein an inflatable bladder is captively located between the movable cylinder portion and the fixed base portion for biasing the movable door into the closed positions, as the inflatable bladder inflates, the inflatable bladder expands and biases the movable cylinder portion away from the fixed base portion and thereby facilitates closing the movable door, and, as such movement occurs, the springs are compressed.

14. The treatment and containment system according to claim 12, wherein a surface of the movable cylinder portion, remote from the fixed base portion of the piston, supports a pair of spaced apart female coupling members while each of the movable doors supports a mating pair of male coupling members, the male coupling members are shaped so as to be captively received and retained by the female coupling members and thereby facilitate releasable coupling and decoupling of the movable door from the respective movable cylinder portion to facilitate quick and easy replacement of the movable doors so that a variety of different movable doors can easily coupled to the female coupling members and thereby facilitate adaptation of the treatment and containment system to a variety of different surface treatment applications.

15. The treatment and containment system according to claim 12, wherein a portion of the fixed base portion of each piston is hingedly connected to the housing by a hinge so that the piston mechanism and the movable door are both supported but pivotably movable relative to the housing, when the movable doors are pivoted into their closed position, the movable doors are located closely adjacent one another with an inwardly facing surface of each one of the movable doors in abutting engagement with a respective sealing gasket surrounding a perimeter of the respective opened end of the housing while an associated resilient material, supported by each respective movable door sealingly engages with a desired portion of the elongate object to be treated so as to achieve an air tight seal between opened end of the housing, the elongate object to be treated and the movable doors.

16. The treatment and containment system according to claim 1, wherein each pair of movable doors is supported by and movable along a pair of upper and lower guide tracks so that the pair of movable doors lie substantially within a plane and an associated piston member facilitates moving the movable doors into either the opened or the closed positions; and an outwardly facing surface of a perimeter of each opened end supports a sealing gasket which is designed to engage and slide against an inwardly facing surface of the movable door, and the sealing gasket surrounds an entire perimeter of the opened end of the housing to facilitate achieving an air tight seal between the perimeter of the opened end of the housing and the respective movable door.

17. The treatment and containment system according to claim 1, wherein the housing includes opposed end panels which each define the opened end of the housing and are designed to closely surround and enclose a desired portion of the elongate object to be treated, and the each one of the movable doors is controlled by one of a hydraulic and a pneumatic mechanism, and each one of the movable doors has a mating inward facing profile which is designed, in combination with a resilient material, to completely encompass and seal against the exterior surface the elongate object to be treated.

18. The treatment and containment system according to claim 1, wherein an outer sleeve is either hydraulically or pneumatically driven;

the outer sleeve is coupled to a central shaft by a spring which allows relative movement between the outer sleeve and the central shaft as soon as a supported central section, of the central shaft, abuts against the elongate object to be treated.

19. The treatment and containment system according to claim 1, wherein each of the movable doors comprises a central section and a pair of outer sections which are each hingedly connected, along an opposed end of the central section, and the hinged connection permits each of outer sections to pivot or move relative to the central section, during closing of the movable door.

20. A treatment and containment system for treating an elongate object to be treated, the treatment and containment system comprising:

a surface treatment device for treating a portion of the elongate object to be treated;

a housing for defining an enclosed treatment area and separating the enclosed treatment area from an operator of the surface treatment device, and the housing being opened at opposed ends thereof;

each opposed opened end of the housing accommodating a pair of movable doors for respectively sealing against an exterior surface of a desired portion of the elongate object to be treated and thereby closing each opposed opened end of the housing when the pairs of doors are in a closed position sealed against the exterior surface of the elongate object to be treated;

the housing having an access aperture therein through which the surface treatment device passes and communicates with the enclosed treatment area, and the access aperture facilitates manipulation of the surface treatment device within the housing;

a transparent viewing aperture for facilitating viewing of the elongate object to be treated by the operator;

wherein the treatment and containment system comprises an automatic safety shutoff feature which includes a pressure sensor located within the treatment area;

the pressure sensor is coupled to a control device which controls the supply of electrical power to the surface treatment device and continually monitors atmospheric pressure within the treatment area and provides and input signal, indicative of the atmospheric pressure of the treatment area, to the control device.

* * * * *